US008794681B2

(12) United States Patent
Crosse

(10) Patent No.: US 8,794,681 B2
(45) Date of Patent: Aug. 5, 2014

(54) GATE LOCKING DEVICE

(71) Applicant: Michael Crosse, Deer Park, NY (US)

(72) Inventor: Michael Crosse, Deer Park, NY (US)

( * ) Notice: Subject to any disclaimer, the term of this patent is extended or adjusted under 35 U.S.C. 154(b) by 0 days.

(21) Appl. No.: 13/629,566

(22) Filed: Sep. 27, 2012

(65) Prior Publication Data

US 2014/0084602 A1 Mar. 27, 2014

(51) Int. Cl.
*E05C 1/04* (2006.01)
*E05B 15/02* (2006.01)

(52) U.S. Cl.
USPC ..... 292/189; 292/340; 292/DIG. 29

(58) Field of Classification Search
USPC ..... 292/340, 240, 189, DIG. 29
See application file for complete search history.

(56) References Cited

U.S. PATENT DOCUMENTS 1,258,624 A * 3/1918 Swank ..... 292/3
2,666,660 A * 1/1954 Youngworth ..... 292/68
2,856,220 A * 10/1958 Easley ..... 292/148
2,940,790 A * 6/1960 Ingalls et al. ..... 292/148
3,174,314 A * 3/1965 Johnson ..... 70/77
3,774,947 A * 11/1973 Duncan ..... 292/68
3,857,593 A * 12/1974 Lening ..... 292/5
3,877,738 A * 4/1975 Nelson ..... 292/68
3,926,018 A * 12/1975 Joersz ..... 70/19
4,111,475 A * 9/1978 McCormick et al. ..... 292/216
4,176,869 A * 12/1979 Gilst ..... 292/304
4,687,238 A * 8/1987 Mintz ..... 292/137
4,790,578 A * 12/1988 Barrera ..... 292/148
5,016,928 A * 5/1991 Segovia ..... 292/213
7,086,351 B1 * 8/2006 Michalek ..... 119/524
7,350,835 B1 * 4/2008 Smith ..... 292/148
7,503,194 B2 * 3/2009 McNeil ..... 70/2
8,250,811 B2 * 8/2012 Zijlstra ..... 49/394

* cited by examiner

*Primary Examiner* — Carlos Lugo
(74) *Attorney, Agent, or Firm* — Lyman H. Smith

(57) ABSTRACT

A gate locking device is easy to operate, tamper proof and kid friendly. The gate locking device can be used on gates that are on both on a leveled area, or with gates that are on grade. The gate locking device includes locking flanges that and rotate and/or pivot to align to allow a lock to be secured thereto. The gate locking device further includes drop bolts that can lock in place into a ground slot. The gate locking device can be used in a single gate design or a dual gate design.

8 Claims, 4 Drawing Sheets

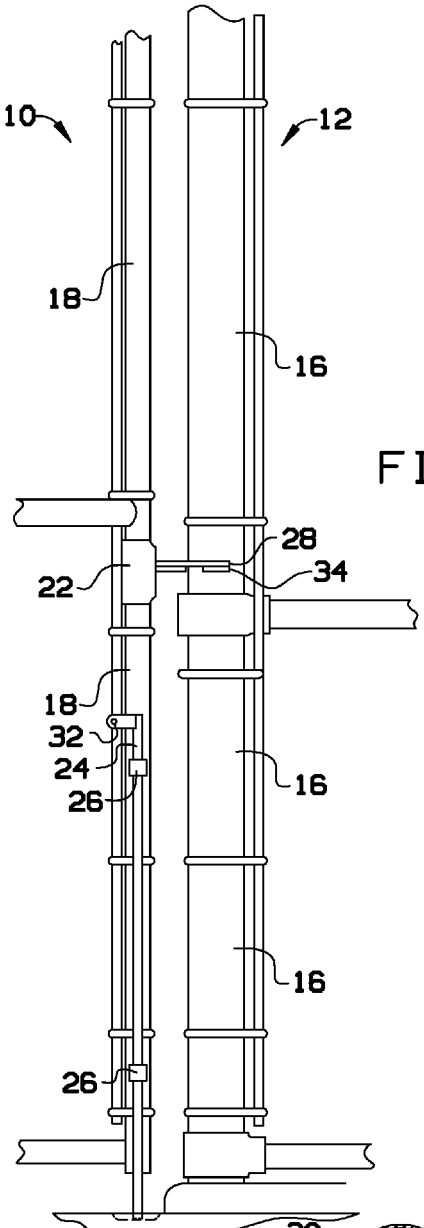
FIG. 1
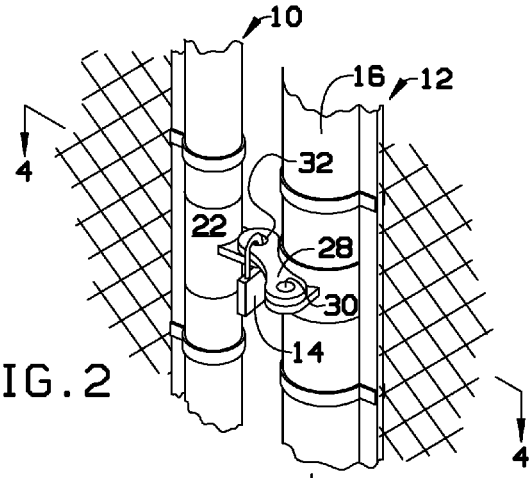
FIG. 2
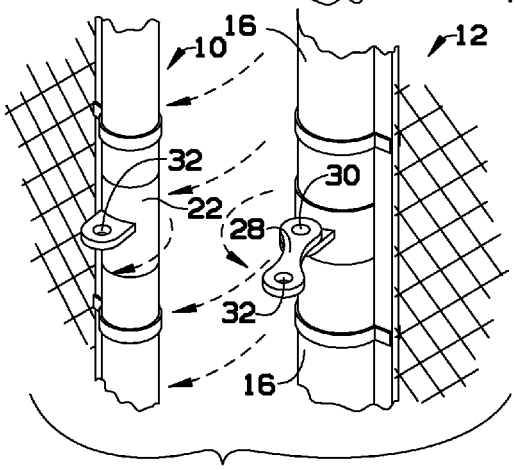
FIG. 3
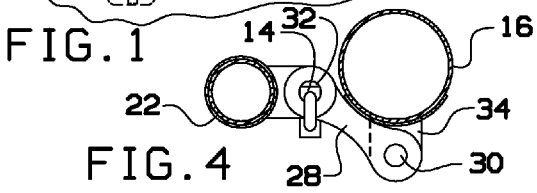
FIG. 4
FIG. 5
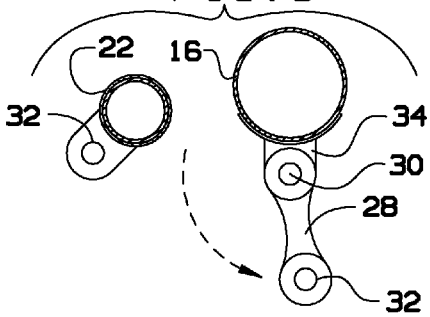

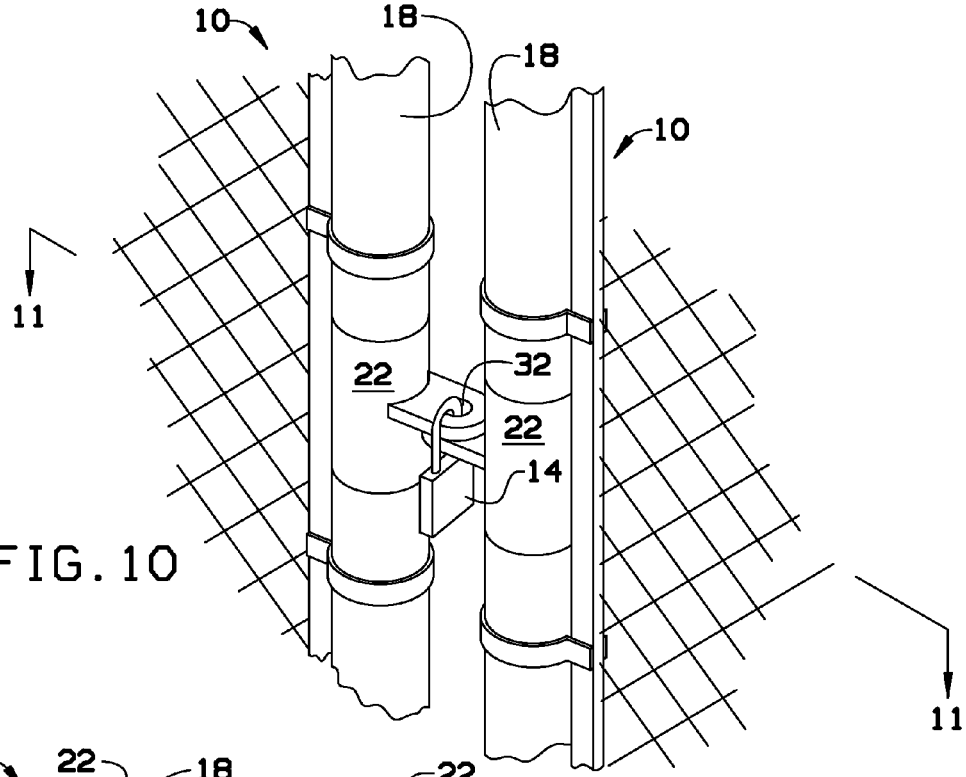
FIG. 10
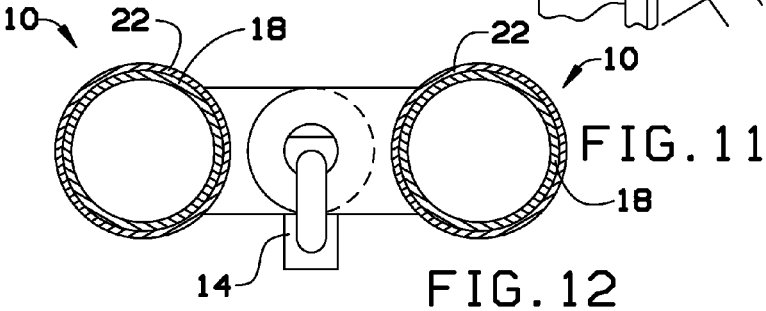
FIG. 11
FIG. 12
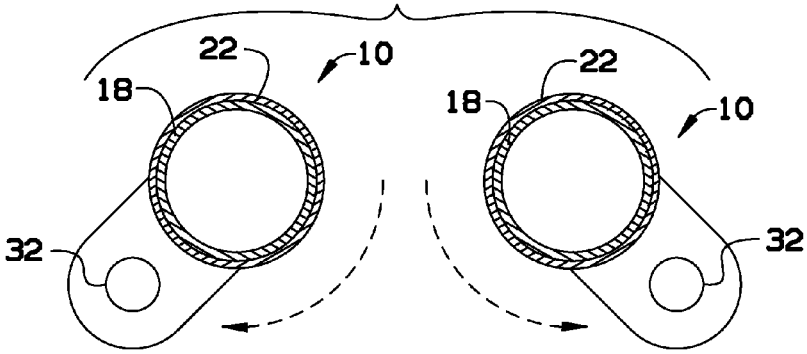

GATE LOCKING DEVICE

BACKGROUND OF THE INVENTION

The present invention relates to a gate locking device and, more particularly, to a gate locking device that can lock on any grade condition.

Previous gate locking devices could not lock on all ground conditions. If the grade of the ground wasn't level, gates had to be raised off the ground so they can be opened. When out of alignment, these conventional gates had to be locked with a chain. This can destroy the finish of the gate and is not very aesthetically pleasing.

As can be seen, there is a need for an improved gate locking device that can function on all ground conditions, including any grade condition.

SUMMARY OF THE INVENTION

In one aspect of the present invention, a gate lock assembly on a first gate assembly comprises a rotating locking flange rotatably disposed on a gate post; a rotating locking flange lock eyelet disposed in the rotating locking flange; a drop bolt disposed alongside the gate lock assembly, the drop bolt fitting into a ground slot when the gate lock assembly is in a locked configuration; and a drop bolt lock eyelet disposed in the drop bolt.

In another aspect of the present invention, a gate lock assembly for securing a gate assembly to a stationary fence assembly comprises a rotating locking flange rotatably disposed on a gate post; a rotating locking flange lock eyelet disposed in the rotating locking flange; a stationary locking flange disposed on a fence post; a swivel lock flange pivotably attached to the stationary locking flange; a swivel lock flange lock eyelet disposed in the swivel lock flange, wherein the swivel lock flange lock eyelet is operable to align with the rotating locking flange lock eyelet with the gate assembly is closed adjacent to the stationary fence assembly; a drop bolt disposed alongside the gate lock assembly, the drop bolt fitting into a ground slot when the gate lock assembly is in a locked configuration; and a drop bolt lock eyelet disposed in the drop bolt.

In a further aspect of the present invention, a gate lock assembly for attaching a first gate assembly with a second gate assembly comprises a first rotating locking flange rotatably disposed on a first gate post of the first gate assembly; a second rotating locking flange rotatably disposed on a second gate post of the second gate assembly; a first rotating locking flange lock eyelet disposed in the first rotating locking flange; a second rotating locking flange lock eyelet disposed in the second rotating locking flange; a first drop bolt disposed alongside the first gate assembly, the first drop bolt fitting into a first ground slot when the first gate assembly is in a locked configuration; a first drop bolt lock eyelet disposed in the first drop bolt; a second drop bolt disposed alongside the second gate assembly, the second drop bolt fitting into a second ground slot when the second gate assembly is in the locked configuration; a second drop bolt lock eyelet disposed in the second drop bolt, wherein the first drop bolt lock eyelet is operable to align with the second drop bolt lock eyelet with the first and second gate assemblies are in the locked configuration.

These and other features, aspects and advantages of the present invention will become better understood with reference to the following drawings, description and claims.

BRIEF DESCRIPTION OF THE DRAWINGS

FIG. 1 is a front view of a single-gate gate locking device according to an exemplary embodiment of the present invention;

FIG. 2 is a detailed perspective view of a locking flanges of the gate locking device of FIG. 1 in a locked configuration;

FIG. 3 is a detailed perspective view of the locking flanges of FIG. 2 in an unlocked configuration;

FIG. 4 is a cross-sectional view taken along line 4-4 of FIG. 2;

FIG. 5 is a cross-sectional view, similar to FIG. 4, but showing the locking flanges in an unlocked configuration;

FIG. 10 is a perspective view of a dual-gate gate locking device according to an exemplary embodiment of the present invention;

FIG. 11 is a cross-sectional view taken along line 11-11 of FIG. 10;

FIG. 12 is a cross-sectional view, similar to FIG. 11, showing the locking flanges in an unlocked configuration;

DETAILED DESCRIPTION OF THE INVENTION

Figure 6:
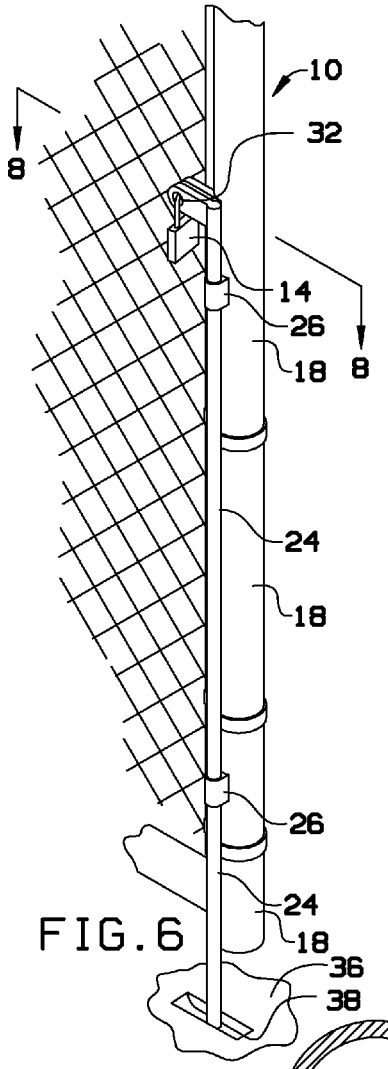
FIG. 6 is a perspective view of the gate locking device of FIG. 1 with a drop bolt in a locked configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a gate locking device that is easy to operate, tamper proof and kid friendly. The gate locking device can be used on gates that are on both on a leveled area, or with gates that are on grade. The gate locking device includes locking flanges that and rotate and/or pivot to align to allow a lock to be secured thereto. The gate locking device further includes drop bolts that can lock in place into a ground slot. The gate locking device can be used in a single gate design or a dual gate design.

Referring to FIGS. 1 through 9, a gate locking device for a single-gate design can be used to interconnect a stationary fence assembly 12 with a gate assembly 10. The stationary fence assembly 12 can include a fence post 16 at an end of the stationary fence assembly 12. A stationary locking flange 34 can be attached to the fence post 16. Typically, the stationary locking flange 34 can extend from the fence post 16 in a direction of movement of the gate assembly 10.

A swivel lock flange 28 can be connected to the stationary locking flange 34 with a tamper proof pressed steel rivet 30. A lock eyelet 32 can be disposed at a distal end of the swivel lock flange 28.

The gate assembly 10 can include a gate post 18. A rotating locking flange 22 can be connected with the gate post 18 such that the rotating locking flange 22 can rotate along an axis of the gate post 18. A lock eyelet 32 of the rotating locking flange 22 can be disposed in the rotating locking flange 22. When the gate assembly 10 is in a closed configuration, the lock eyelet 32 of the rotating locking flange 22 can be rotated to align with the lock eyelet 32 of the swivel lock flange 28. A locking device 14 can pass through the lock eyelets 32 to lock the gate assembly 10 to the fence assembly 12.

The gate assembly 10 can include a drop bolt 24 guided by drop bolt guides 26 attached to the gate post 18. The drop bolt 24 can be disposed in a ground slot 38 disposed in the ground 36 under the gate assembly 10 when in a closed configuration. A stationary locking flange 34 can be disposed on the gate post 18 with a lock eyelet 32 formed therein. The drop bolt 24 can be rotated to cause a lock eyelet 32 of the drop bolt 24 to align with the lock eyelet 32 of the stationary locking flange 34.

Figure 7:
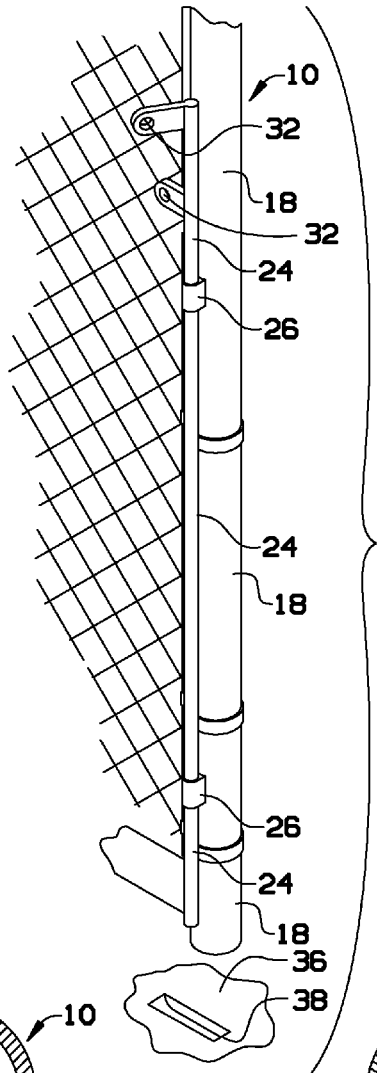
FIG. 7 is a perspective view of the gate locking device of FIG. 6 with the drop bolt in an unlocked configuration.
Figure 8:
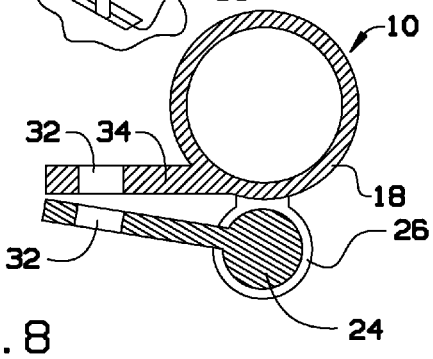
FIG. 8 is a cross-sectional view taken along line 8-8 of FIG. 6.
Figure 9:
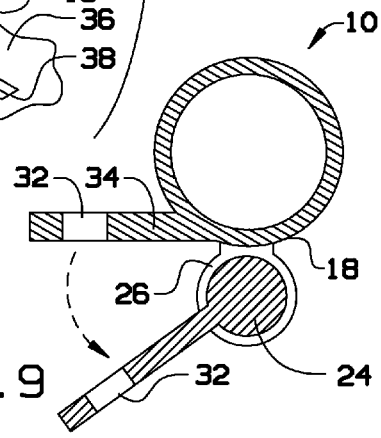
FIG. 9 is a cross-sectional view, similar to FIG. 8, but showing the drop bolt in an unlocked configuration.
Figure 13:
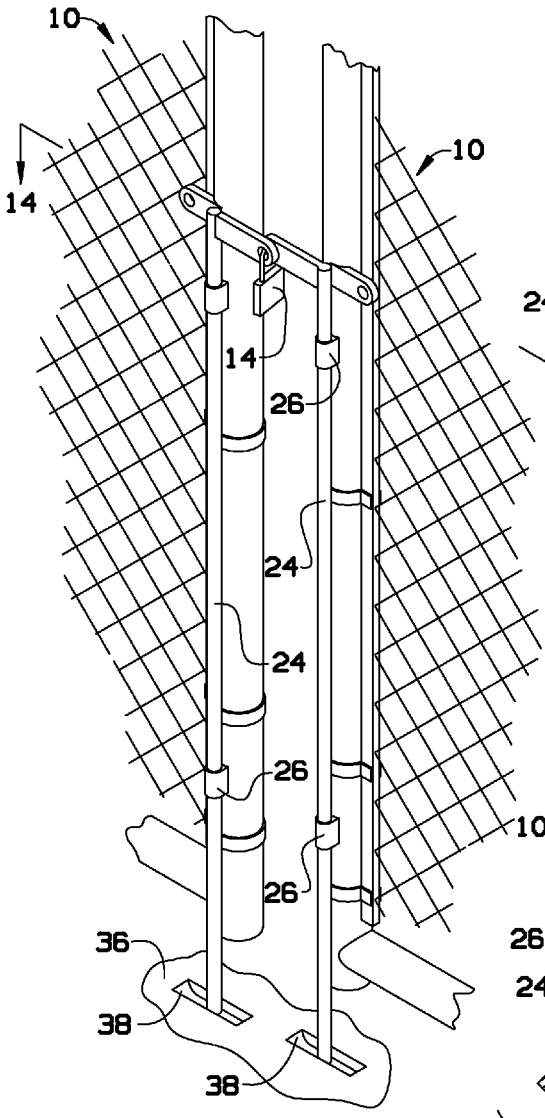
FIG. 13 is a perspective view of dual-gate gate locking device drop bolts in a locked configuration.
Figure 14:
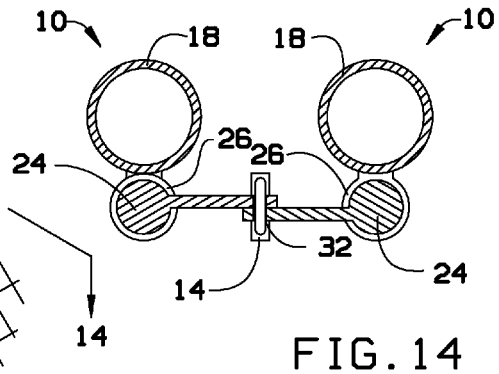
FIG. 14 is a cross-sectional view taken along 14-14 of FIG. 13.
Figure 15:
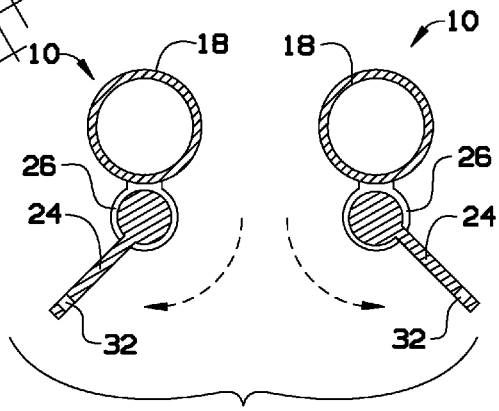
FIG. 15 is a cross-sectional view, similar to FIG. 14, showing the drop bolts in an unlocked configuration.

The drop bolt 24 can be moved between a locked configuration as shown in FIGS. 6 and 8, and an unlocked configuration, as shown in FIGS. 7 and 9. When in the unlocked configuration, the drop bolt 24 can be raised out of the ground slot 38 to permit movement of the gate assembly 10.

Referring not to FIGS. 10 through 15, a gate locking design similar to that described above can be used to secure two gates assemblies 10 together in a locked configuration. The rotating locking flanges 22, described above, can be disposed at adjacent gate posts 18 of adjacent gate assemblies 10 in a dual-gate design according to an exemplary embodiment of the present invention. The rotating locking flanges 22 can be moved to a locked configuration where the lock eyelets 32 of both rotating locking flanges 22 overlap to allow the lock device 14 to be placed therethrough. The rotating locking flanges 22 can be moved between a locked configuration, as shown in FIGS. 10 and 11, and an unlocked configuration, as shown in FIG. 12.

Each gate assembly 10 can include a drop bolt 24, similar to that described above. The lock eyelet 32 of each drop bolt 24 can locked together to secure both gate assemblies 10 in the locked configuration, with the drop bolts 24 both secured into the ground slot 38. Each gate assembly can include the stationary locking flange 34, as described above, where one gate assembly 10 can be locked into the ground slot 38 while the other one of the gate assemblies 10 can be allowed to open and close.

The gate lock assemblies described above can be used with various sizes of gates and fences. Depending on the user's application, in some embodiments multiple rotating locking flanges 22 can be used to secure the gate assemblies 10 to adjacent gate assemblies 10 or to stationary fence assemblies 12 at different heights. For example, a 10-foot high fence gate may have a rotating locking flanges 32/stationary locking flange 34 at an upper position and a mid position, with the drop bolts 24 securing the gate assemblies 10 at a lower position.

It should be understood, of course, that the foregoing relates to exemplary embodiments of the invention and that modifications may be made without departing from the spirit and scope of the invention as set forth in the following claims.

What is claimed is:

1. A gate lock assembly for securing a gate assembly to a stationary fence assembly, comprising:

a rotating locking flange rotatably disposed on a gate post of the gate assembly, the rotating locking flange rotating about a longitudinal axis of the gate post;

a rotating locking flange lock eyelet disposed in the rotating locking flange;

a stationary locking flange disposed on a fence post of the stationary fence assembly;

a swivel lock flange pivotably attached to the stationary locking flange; and a swivel lock flange lock eyelet disposed in the swivel lock flange, wherein the swivel lock flange lock eyelet is operable to align with the rotating locking flange lock eyelet with the gate assembly is closed adjacent to the stationary fence assembly;

wherein a lock member is capable of being positioned through both eyelets to secure the gate assembly with the stationary fence assembly.

2. The gate lock assembly of claim 1, wherein the swivel lock flange is attached to the fence post stationary locking flange with a tamper proof pressed steel rivet.

3. The gate lock assembly of claim 1, further comprising:

a drop bolt disposed alongside the gate lock assembly, the drop bolt fitting into a ground slot when the gate lock assembly is in a locked configuration; and a drop bolt lock eyelet disposed in the drop bolt.

4. The gate lock assembly of claim 1, further comprising a stationary drop eye bolt locking flange disposed on the gate post, the stationary drop eye bolt locking flange having a stationary drop eye bolt locking flange eyelet aligning with the drop bolt lock eyelet, wherein a lock positioned between both eyelets secure the drop bolt into the ground slot.

5. A gate lock assembly for attaching a first gate assembly with a second gate assembly, comprising:

a first rotating locking flange rotatably disposed on a first gate post of the first gate assembly, the first rotating locking flange rotating rotating about a first longitudinal axis of the first gate post;

a second rotating locking flange rotatably disposed on a second gate post of the second gate assembly, the second rotating locking flange rotating about a second longitudinal axis of the second gate post;

a first rotating locking flange lock eyelet disposed in the first rotating locking flange;

a second rotating locking flange lock eyelet disposed in the second rotating locking flange;

wherein the first rotating locking flange lock eyelet is operable to align with the second rotating locking flange lock eyelet when the first gate post is closed adjacent to the second gate post;

wherein a locking member is capable of being positioned through the first and second locking flange lock eyelets to secure the gate assembly with the stationary fence assembly;

a first drop bolt disposed alongside the first gate assembly;

a first drop bolt lock eyelet disposed in the first drop bolt;

a second drop bolt disposed alongside the second gate assembly; and a second drop bolt lock eyelet disposed in the second drop bolt.

6. The gate lock assembly of claim 5, wherein:

the first drop bolt fits into a first ground slot when the first gate assembly is in a locked configuration; and the second drop bolt fits into a second ground slot when the second gate assembly is in the locked configuration.

7. The gate lock assembly of claim 5, wherein the first drop bolt lock eyelet is operable to align with the second drop bolt lock eyelet with the first and second gate assemblies are in the locked configuration.

8. The gate lock assembly of claim 5, further comprising first and second stationary drop eye bolt locking flanges disposed on the first and second gate posts, the stationary drop eye bolt locking flanges having stationary drop eye bolt locking flange eyelets aligning with the first and second drop bolt lock eyelets, wherein a lock positioned between both eyelets secure the drop bolts into the ground slot.

* * * * *